United States Patent [19]

Barakitis et al.

[11] Patent Number: 4,843,282

[45] Date of Patent: Jun. 27, 1989

[54] GLOW DISCHARGE STARTER CONTAINING SILVER

[75] Inventors: Nikolaos Barakitis, Salem; Gregory Zaslavsky, Brookline, both of Mass.

[73] Assignee: GTE Products Corporation, Danvers, Mass.

[21] Appl. No.: 156,123

[22] Filed: Feb. 16, 1988

[51] Int. Cl.[4] ..... H01J 17/04; H01J 61/06; H01J 61/64

[52] U.S. Cl. ..... 313/619; 313/146; 313/633

[58] Field of Search ..... 313/147, 146, 151, 620, 313/558, 631, 633

[56] References Cited

U.S. PATENT DOCUMENTS 2,241,240 5/1941 Chirelstein ..... 313/151 X
2,864,024 12/1958 Ahsmann ..... 313/633 X

*Primary Examiner*—Kenneth Wieder
*Attorney, Agent, or Firm*—Carlo S. Bessone

[57] ABSTRACT

This invention relates to a glow discharge starter having an hermetically sealed envelope containing an ionizable medium, a bimetallic electrode and a counter electrode located within the envelope. A silver plating completely covers the nickel-containing portions of the electrodes. Preferably, the thickness of the silver plating is from about 0.0002 inch to about 0.0004 inch. The present invention results in a glow discharge starter which has stable electrical characteristics, does not require the use of complex gas mixtures, and has an increased life.

6 Claims, 3 Drawing Sheets

GLOW DISCHARGE STARTER CONTAINING SILVER

TECHNICAL FIELD

This invention relates in general to glow discharge starters for arc discharge lamps and more particularly to glow discharge starters intended for high line voltage (i.e., 220–240 volts AC).

BACKGROUND OF THE INVENTION

A glow discharge starter is usually connected across or in parallel with an arc discharge lamp and contains a pair of electrodes. At least one of the electrodes comprises a bimetallic element which, when heated as a result of the glow discharge, bends towards the other electrode. When contact is made, the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge sequence is repeated until lamp ignition occurs.

An example of a glow discharge starter of the aforementioned type is described in the book "Light Sources" by Elenbaas, Philips Technical Library, pages 102–103. Other examples of glow discharge starters are shown and described in U.S. Pat. Nos. 2,321,910 and 2,285,805.

The glow discharge starter is designed such that the contacts close at a voltage chosen between the maximum lamp voltage and the minimum supply voltage (i.e., closure voltage). The contacts of the starter must also remain open at voltages less than the maximum lamp voltage (i.e., non-reclosure voltage). For 220 volt line specifications, a starter typically has a maximum closure voltage of 180 volts and a minimum non-reclosure voltage of 140 volts. It is important that the electrical parameters of the glow discharge starter remain within this range throughout the life of the starter. Some conventional glow discharge starters intended for high line voltage applications fail in less than 6000 cycles.

To make gases break down at a particular voltage and discharge extinguish at a slightly lower voltage, various methods have been employed in the past. It is known to use zinc in high voltage starters. In one commercially available starter, the zinc is plated on the bimetallic element at a thickness of from about 0.001 to 0.0005 inch. Such plating keeps the closure and non-reclosure voltages within a preestablished specification range for a maximum of approximately 3000 cycles. At the contact points, the zinc is rapidly depleted which exposes nickel-containing parts (e.g., bimetallic element, post and counter electrode) to the discharge. The exposed nickel is spattered over the internal surfaces of the glow discharge starter changing the work function. As a result, the glow discharge starter fails to maintain the closure and non-reclosure voltages within the preestablished limits past 3000 cycles. More specifically, the non-reclosure voltage has been found to drop to about 130 volts while the reclosure voltage increases to about 200 volts. U.S. Pat. No. 2,740,861 is another example of a glow discharge starter using a coating of zinc.

Silver has been used in the past as a contact material in glow discharge starters. During the seasoning process (i.e., aging) as well as during the entire life of the starter, the silver from the contacts is spattered over portions of the metal surfaces. The solid silver serves as a source of the work function reducing material during the life of the starter. However, since nickel-containing parts are still exposed to the electrical discharge, the electrical characteristics of the starter tend to change. As a result, these silver-containing starters resort to the use of complex gas mixtures to stabilize the characteristics of the glow discharge starters during life. Fill gas mixtures consisting of combinations of, for example, hydrogen, helium, neon, argon, and krypton 85 have been used. Hydrogen and helium can be absorbed by the starter envelope, getter material or internal metal parts which results in a change in the gas composition and consequently a change in the electrical characteristics of the glow discharge starter during life.

SUMMARY OF THE INVENTION

It is therefore, an object of the present invention to obviate the disadvantages of the prior art.

It is another object of the present invention to provide an improved glow discharge starter suitable for high line voltages and having a maximum closure voltage of 180 volts and a minimum non-reclosure voltage of 140 volts.

It is another object of the present invention to provide an improved glow discharge starter having stable electrical characteristics.

It is a further object of the present invention to provide an improved glow discharge starter which does not require the use of complex gas mixtures to maintain the electrical characteristics.

It is still another object of the present invention to provide an improved glow discharge starter having an increased life.

It is still another object of the present invention to provide an improved method of manufacturing a glow discharge starter.

These objects are accomplished, in one aspect of the invention, by the provision of a glow discharge starter comprising an hermetically sealed envelope containing an ionizable medium, and a bimetallic electrode and a counter electrode located within the envelope. The bimetallic electrode includes a bimetallic element secured to a post. A portion of at least one of the electrodes is of a nickel-containing material. A silver plating completely covers the nickel-containing portion of the electrode.

In accordance with further aspects of the invention, the bimetallic electrode and the counter electrode are of nickel-containing materials and the silver plating completely covers the electrodes. Preferably the electrodes are of a nickel-steel alloy.

In accordance with further teachings of the present invention, the silver plating has a thickness of from about 0.0002 inch to about 0.0004 inch. Preferably, the silver plating has a thickness of about 0.0002 inch.

In accordance with further embodiments of the invention, the ionizable medium medium includes argon at a predetermined pressure which is preferably within the range of from about 12.0 torr to about 18.0 torr.

In accordance with additional aspects of this invention, a method of making a glow discharge starter is provided. The method includes the steps of providing an envelope, forming a bimetallic electrode with a bimetallic element and a post, providing a counter electrode, completely covering the electrodes with a silver plating, sealing the bimetallic electrode and the counter electrode within the envelope, exhausting th envelope, filling the envelope with a gas at a predetermined pressure, and hermetically sealing the envelope.

In accordance with still further teachings of the present invention, the silver plating is coated at a thickness of from about 0.0002 inch to about 0.0004 inch.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
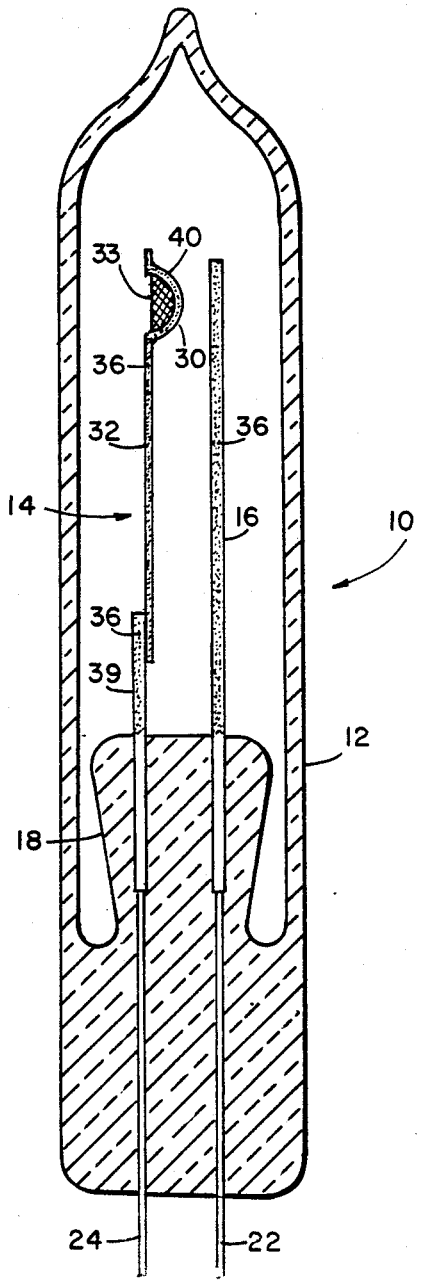
FIG. 1 is a front elevational view of an embodiment of a glow discharge starter according to the invention.

Referring now to the drawings with greater particularity, there is shown in FIG. 1 a glow discharge starter 10 comprising an hermetically sealed envelope 12 containing an ionizable medium. The ionizable medium may comprise an inert gas or combinations thereof at a low pressure typically within the range of from about 12.0 torr to about 18.0 torr. A bimetallic electrode 14 and a counter electrode 16 are located within envelope 12 and sealed in glass bead 18. Electrodes 14 and 16 are electrically connected to or as illustrated in FIG. 1, formed from lead-in conductors 22 and 24, respectively. Bimetallic electrode 14 includes a post 39 and a bimetallic element 32. Bimetallic element 32 includes a free end 30 and consists of two strips of metal having different linear coefficients of expansion welded together. The side of lower expansion is formed of a nickel-steel alloy while the side of higher expansion is formed of chrome iron. In the embodiment in FIG. 1, the side of higher coefficient of expansion is on the outside (i.e., the side away from counter electrode 16) such that the free end 30 of bimetallic element 32 engages counter electrode 16 upon flexure of bimetallic element 32. The other end of bimetallic element 32 is secured to post 39 by welding.

Further included in glow discharge starter 10 is a getter holder 40 which is formed in bimetallic element 32. The getter holder may contain, for example, zirconium 33 or a mixture of barium, magnesium and thorium. Alternatively, a separate getter holder may be secured to one of the electrodes and comprise a getter holder strip having a getter cup formed therein or secured thereto.

In accordance with the teachings of the present invention, all of the nickel-containing portions of the electrodes exposed to the discharge are completely covered with a silver plating 36. By "completely" is meant that the coating is continuous and does not contain voids. Preferably, the bimetallic electrode and the counter electrode are formed from nickel-containing alloys and the silver plating completely covers the electrodes which include post 39, bimetallic element 32 and counter electrode 16. The thickness of the silver plating is from about 0.0002 inch to about 0.0004 inch.

Figure 2:
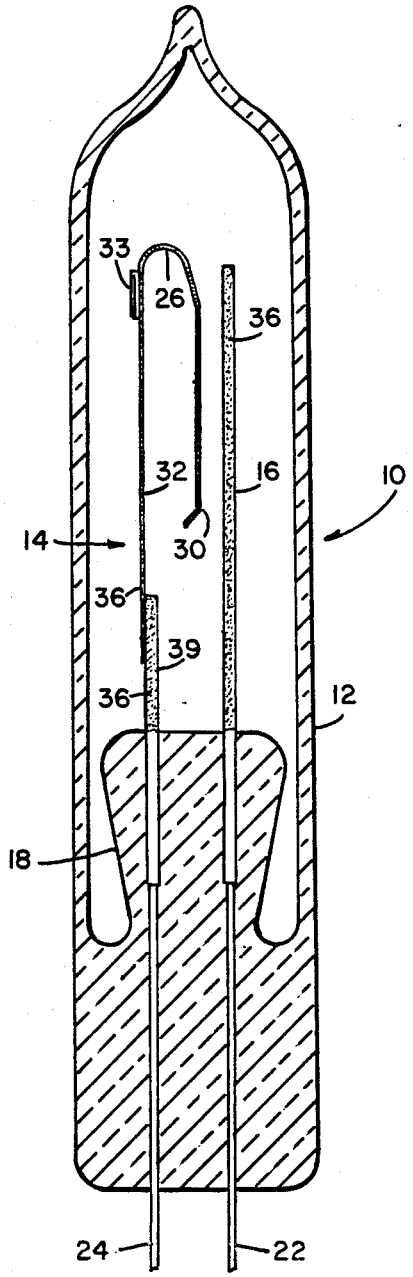
FIG. 2 is a front elevational view of another embodiment of a glow discharge starter according to the invention.

An alternative construction of a glow discharge starter is shown in FIG. 2 wherein the bimetallic element further includes a curved portion 26. The side of higher coefficient of expansion is on the inside curve of the U so that the bimetallic element opens out and engages the counter electrode. After being silver plated, a coating 33 of zirconium is disposed on a portion of the bimetallic element. The counter electrode in FIGS. 1 and 2 may be constructed as a second bimetallic electrode comprising a second post and bimetallic element. The shape of the bimetallic element may vary from what is shown in FIGS. 1 and 2.

As to the manufacture of the above-described glow discharge starters, a suitable envelope is first provided. A bimetallic electrode is formed with a bimetallic element and a post. A counter electrode is provided. The bimetallic electrode and the counter electrode are completely covered with a silver plating having a thickness of from about 0.0002 inch to about 0.0004 inch. The electrodes are sealed within the envelope in the normal fashion. The interior of the envelope is exhausted by connecting the envelope to a vacuum system. The envelope is filled with a gas (e.g., argon) at a predetermined pressure and finally hermetically sealed.

Figure 3:
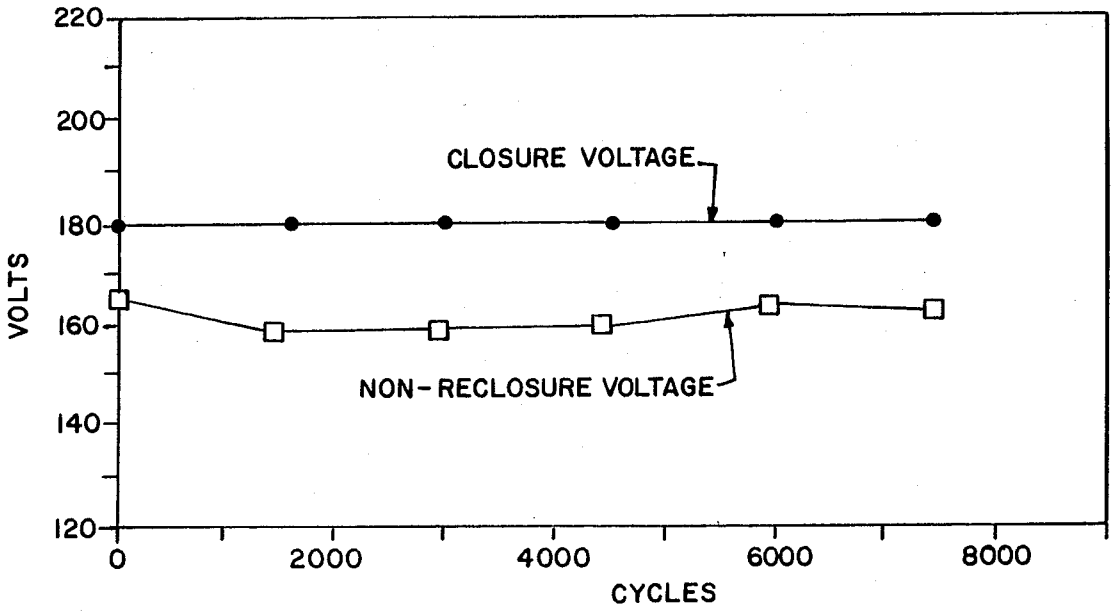
FIG. 3 is an illustration of the closure and non-reclosure voltages as a function of life cycles for starters made in accordance with the teachings of the present invention.

In a typical but not limiting example of a glow discharge starter made in accordance with the teachings of the present invention, the envelope is formed from potash soda lead glass having an outside diameter of 0.285 inch (7.2 millimeters), a wall thickness of 0.027 inch (0.69 millimeter) and an overall length of 1.1 inches (28 millimeters). The post and counter electrode were formed from nickel plated iron. The bimetallic element contained 0.2 percent chromium, 7.4 percent manganese, 19.4 percent nickel and the balance iron. The post, bimetallic element and counter electrode were completely covered with a silver plating with a thickness of approximately 0.0003 inch. The hermetically sealed envelope contained an argon fill at a pressure of 15 torr. Lifetest data on the above glow discharge starters was obtained by operating the starters on a 20 seconds on and 40 seconds off cycle. In FIG. 3, the data is plotted on the basis of "volts" as ordinate and "cycles" as abscissa. The data show that at 7500 cycles, the closure voltage remained at 180 volts and the reclosure voltage remained greater than 140 volts. Prior art starters having a coating a zinc were tested on a similar cycle but failed to maintain the preestablished electrical characteristics past 3000 cycles.

There thus has been shown and described an improved glow discharge starter wherein the nickel-containing parts of the starter which are exposed to the discharge are completely covered with a silver plating. As a result, the starter has stable electrical characteristics, does not require the use of complex gas mixtures to maintain the electrical characteristics and has an increased life.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A glow discharge starter comprising an hermetically sealed envelope containing an ionizable medium, a bimetallic electrode and a counter electrode located within said envelope, said bimetallic electrode including a bimetallic element secured to a post, said bimetallic electrode and said counter electrode being of nickel-containing materials, and a silver plating completely covering said electrodes.

2. The glow discharge starter of claim 1 wherein said electrodes are of a nickel-iron alloy.

3. The glow discharge starter of claim 1 wherein said silver plating has a thickness of from about 0.0002 inch to about 0.0004 inch.

4. The glow discharge starter of claim 3 wherein said silver plating has a thickness of about 0.0002 inch.

5. The glow discharge starter of claim 1 wherein said ionizable medium includes argon at a predetermined pressure.

6. The glow discharge starter of claim 5 wherein said predetermined pressure is within the range of from about 12.0 torr to about 18.0 torr.

* * * * *